US008286811B1

(12) United States Patent
Adamczak

(10) Patent No.: US 8,286,811 B1
(45) Date of Patent: Oct. 16, 2012

(54) CHILD PROOF CLOSURE CAP FOR CONTAINERS HAVING CURVED SKIRT

(76) Inventor: Gregory Mark Adamczak, Stamford, CT (US)

( * ) Notice: Subject to any disclaimer, the term of this patent is extended or adjusted under 35 U.S.C. 154(b) by 161 days.

(21) Appl. No.: 12/806,108

(22) Filed: Aug. 5, 2010

(51) Int. Cl.
*B65D 55/02* (2006.01)

(52) U.S. Cl. ..... 215/220; 215/221; 215/225

(58) Field of Classification Search ..... 215/216–221, 215/224, 225
See application file for complete search history.

(56) References Cited

U.S. PATENT DOCUMENTS

| | | | | |
|---|---|---|---|---|
| 3,792,793 | A * | 2/1974 | Rose | 215/221 |
| 3,944,102 | A * | 3/1976 | Grau | 215/251 |
| 4,157,142 | A * | 6/1979 | Kong | 215/223 |
| 4,360,113 | A | 11/1982 | Luker | |
| 4,365,721 | A | 12/1982 | Montgomery | |
| 4,576,298 | A * | 3/1986 | Boik | 215/252 |
| 4,609,114 | A * | 9/1986 | Roy | 215/220 |
| 4,991,729 | A * | 2/1991 | Hunter | 215/206 |
| 4,997,096 | A * | 3/1991 | Kusz | 215/201 |
| 5,411,157 | A * | 5/1995 | King et al. | 215/330 |
| 5,611,443 | A * | 3/1997 | King | 215/220 |
| 6,085,920 | A * | 7/2000 | Moretti | 215/220 |
| 6,206,216 | B1 * | 3/2001 | Stalions | 215/220 |
| 6,609,637 | B1 * | 8/2003 | Suffa | 222/545 |
| 7,100,785 | B1 * | 9/2006 | Suffa | 215/330 |
| 7,401,707 | B2 * | 7/2008 | Brozell et al. | 215/220 |
| 7,571,825 | B2 | 8/2009 | Takahashi | |
| 8,056,742 | B2 * | 11/2011 | Brozell et al. | 215/220 |
| 2004/0182814 | A1 * | 9/2004 | Suffa | 215/216 |
| 2006/0219651 | A1 * | 10/2006 | Takahashi | 215/220 |

* cited by examiner

*Primary Examiner* — J. Gregory Pickett
*Assistant Examiner* — Ned A Walker
(74) *Attorney, Agent, or Firm* — St. Onge Steward Johnston & Reens LLC

(57) ABSTRACT

A child-proof closure cap for containers having an inner cap and an outer cap assembled for tilting with respect to each other. The inner cap includes a partially spherical or curved outer surface with notches for engagement with internal teeth on a partially spherical or curved inner surface of the outer cap to facilitate removal of the closure cap from the container with either left hand or right hand operation according to user's natural ability.

20 Claims, 3 Drawing Sheets

CHILD PROOF CLOSURE CAP FOR CONTAINERS HAVING CURVED SKIRT

FIELD OF THE INVENTION

The invention relates to closure caps for containers including bottles and jars, and particularly to a child proof Closure cap easily removed by right hand or left hand operation.

BACKGROUND OF THE INVENTION

Child proof closure caps are ordinarily used on containers for tablets and liquid preparations sold by prescription or over-the-counter as a precaution against children gaining access to and consuming such preparations. All too often, child proof closure caps present a significant impediment for adults in opening the containers especially adults lacking the necessary level of hand and finger strength or cognitive ability to cope with the cap design.

Closure caps in attaining child proof utility are often complicated in design and construction thereby adding undesired manufacturing costs to an overall package. Moreover, the design and construction is normally intended for use in a right-handed world thereby presenting a further significant impediment to those who are left-handed.

There is need then for a closure cap that combines child proof design, low manufacturing cost, and that is equally suited for right and left hand removal from a container.

SUMMARY OF THE INVENTION

This invention is directed to closure cap suited for child proof applications in packaging tablets and liquids for medicinal or other restricted use, and suited for ease of right and left hand removal of the cap from a container.

A preferred embodiment of closure cap according to the invention comprises an inner cap for connection to and for sealing the open end of a container. The inner cap comprises a top panel and depending skirt for covering and sealing a container at its threaded neck. The skirt inner surface is threaded for screwing the closure onto the corresponding threads on of a container neck. The skirt outer surface has a partially spherical or curved profile (e.g., a spherical section) extending entirely about the skirt for engagement with an outer cap for a purpose detailed below. The skirt outer surface at the juncture with top panel contains two sets of notches with each set occupying approximately one-half the perimeter of the skirt and top panel, with one set of notches being canted to the right, the other set to the left. The notches cooperate with drive teeth depending from inside an outer cap for removing the inner cap from the container.

An outer cap according to the invention comprises a top panel and a skirt depending from the perimeter of the panel. The outer cap skirt has a partially spherical or curved inner surface (e.g., a spherical section) of the same curvature as the outer surface of the inner cap skirt. The outer cap then is snapped in place over the inner cap and by reason of the partially spherical or curved surface interface of outer cap skirt with inner cap skirt, the outer cap to a specified degree tilts in every direction with respect to the inner cap. At the inside of the outer cap at the junction of top panel and depending skirt, the outer cap is fitted with a plurality of drive teeth for insertion into the inner cap notches for twisting the inner cap off the container neck.

The drive teeth are preferably set at diametrically opposed positions on the underside of the outer cap, and engage inner cap notches by tilting the outer cap with respect to the inner cap. A user selects direction of tilt by using either right hand or left hand according to native ability, and twists outer cap either to right or to left in removing inner cap to open the container.

It is to be understood then, a child proof right and left hand operable closure cap according to the invention comprises two operating components readily fabricated using commonly available plastic or equivalent material in well known manufacturing processes including plastics molding and metal stamping.

Specific examples are included in the following description for purposes of clarity, but various details can be changed within the scope of the present invention.

An object of the invention is to provide a new and useful child proof closure cap.

Another object of the invention is to provide a two-piece closure cap of inner and outer cap members adapted for right hand and left hand use.

Another object of the invention is to provide a two piece closure cap of inner and outer cap members where the outer cap tilts with respect to the inner cap to facilitate operation of closure with equal ease using right hand or left hand according to user's preference.

Another object of the invention is to provide a child proof two piece closure cap in which outer cap tilts in every direction with respect to inner cap whereupon drive teeth on the outer cap engage receptor notches on the inner cap for removal of inner cap when user with right hand or left hand selects specific direction of tilt of outer cap for twisting off the inner cap.

Other and further objects of the invention will become apparent with an understanding of the following detailed description of the invention or upon employment of the invention in practice.

BRIEF DESCRIPTION OF THE DRAWINGS

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE INVENTION

Figure 1:
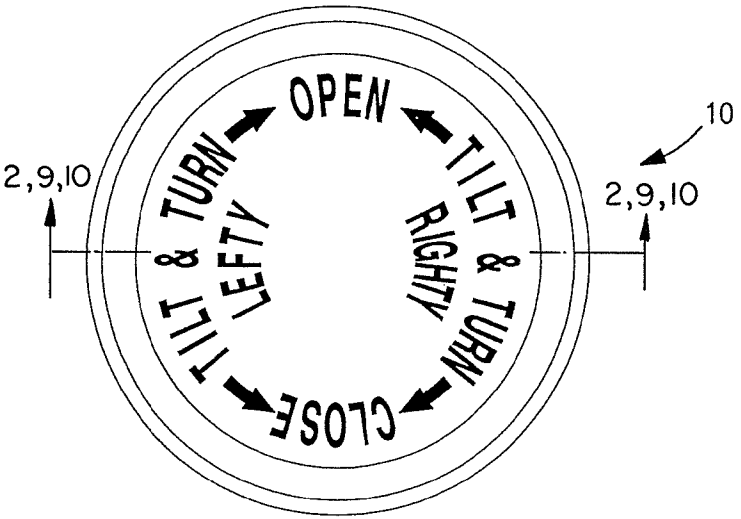
FIG. 1 is a top view of a preferred embodiment of closure cap according to the invention showing top panel legends for right and left hand turns to open and close cap on a container.

Referring now to the drawings, a preferred embodiment of the invention comprises a closure cap 10 suited for child proof applications in packaging medicines and other substances intended for restricted use and to be kept out of the reach of children. The closure cap is designed for right and left hand removal of the cap from a container.

Figure 2:
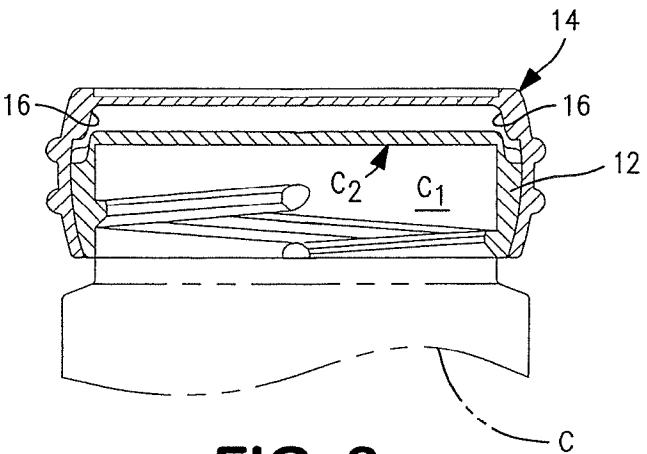
FIG. 2 is a side elevation section view of outer and inner caps in position on a container neck.
Figure 9:
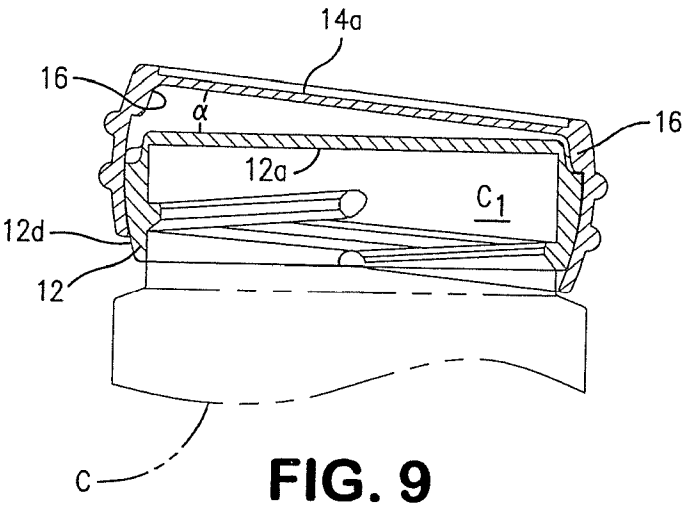
FIG. 9 is a side elevation section view of outer and inner caps tilted into position for right hand removal from a container neck.
Figure 10:
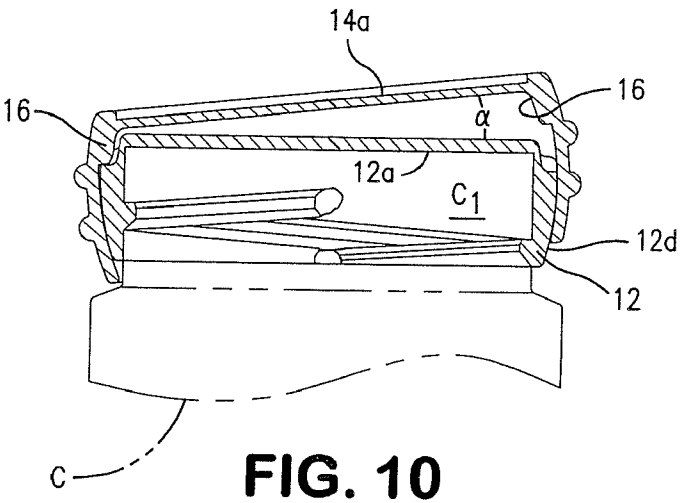
FIG. 10 is a side elevation section view of outer and inner caps tilted into position for left hand removal from a container neck.

A container C shown in dash lines in FIGS. 2, 9, and 10 includes a conventional container in the form of a bottle or jar having body and means for receiving and securing closure cap to container such as threaded neck C1. The top circular edge or rim C2 of the neck defines a sealing surface engaged and sealed by a corresponding surface of the closure cap or by a sealing liner or gasket forming part of the closure cap. The container opening defined by the neck rim may be covered and sealed by a tamperproof disc in a well-known manner.

Figure 3:
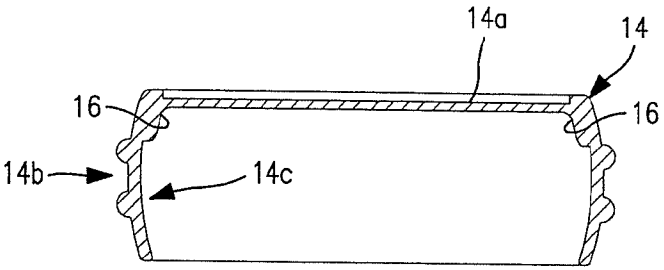
FIG. 3 is a side elevation section view of outer cap of FIG. 2.
Figure 4:
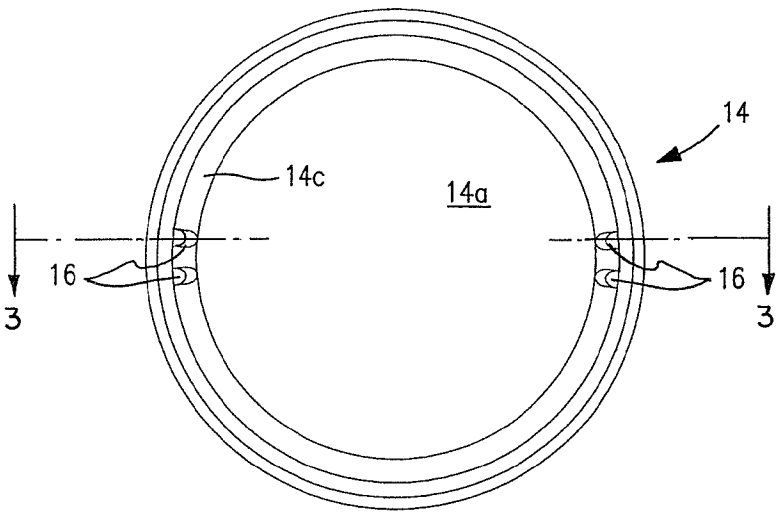
FIG. 4 is a bottom view of outer cap of FIG. 2.
Figure 7:
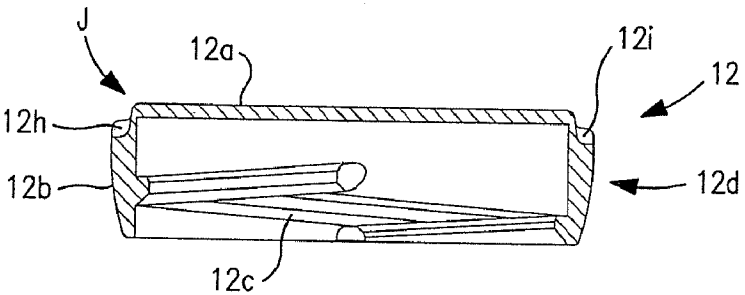
FIG. 7 is a side elevation section view of inner cap of FIG. 2.

A closure cap according to the invention comprises an inner cap 12 for connection to the neck for sealing the open end of a container. The inner cap comprises top panel 12*a* and depending skirt 12*b* for covering and sealing a container at its threaded neck. The skirt inner surface has helical bead 12*c* (FIG. 7) for screwing the closure onto the corresponding threads on of the container neck. The outer surface 12*d* of the skirt of inner cap 12 has a partially spherical or curved surface (e.g., a spherical section) extending entirely about the skirt for engagement with an outer cap 14 (FIGS. 2-4) for a purpose detailed below. The inner cap skirt 12*b* has a plurality of vertical slits 12*e* extending from circumferential mid-line 12*f* (FIG. 8) to bottom edge 12*g* of the skirt to facilitate assembly of outer cap onto inner cap.

Figure 6:
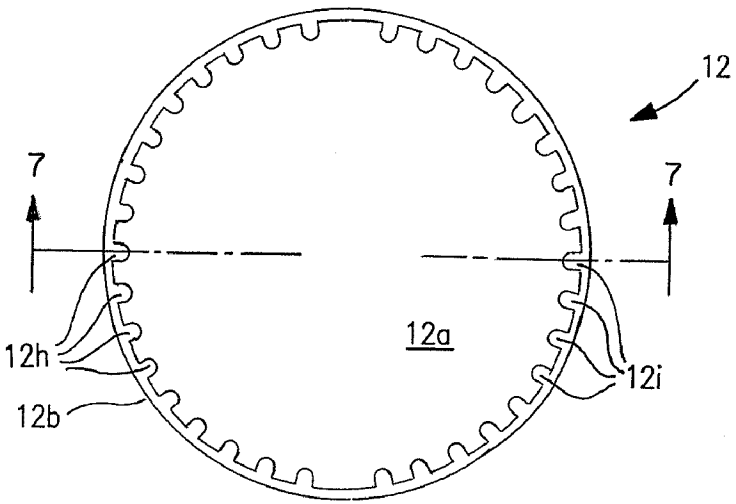
FIG. 6 is a top view of the inner cap of FIG. 2
Figure 8:
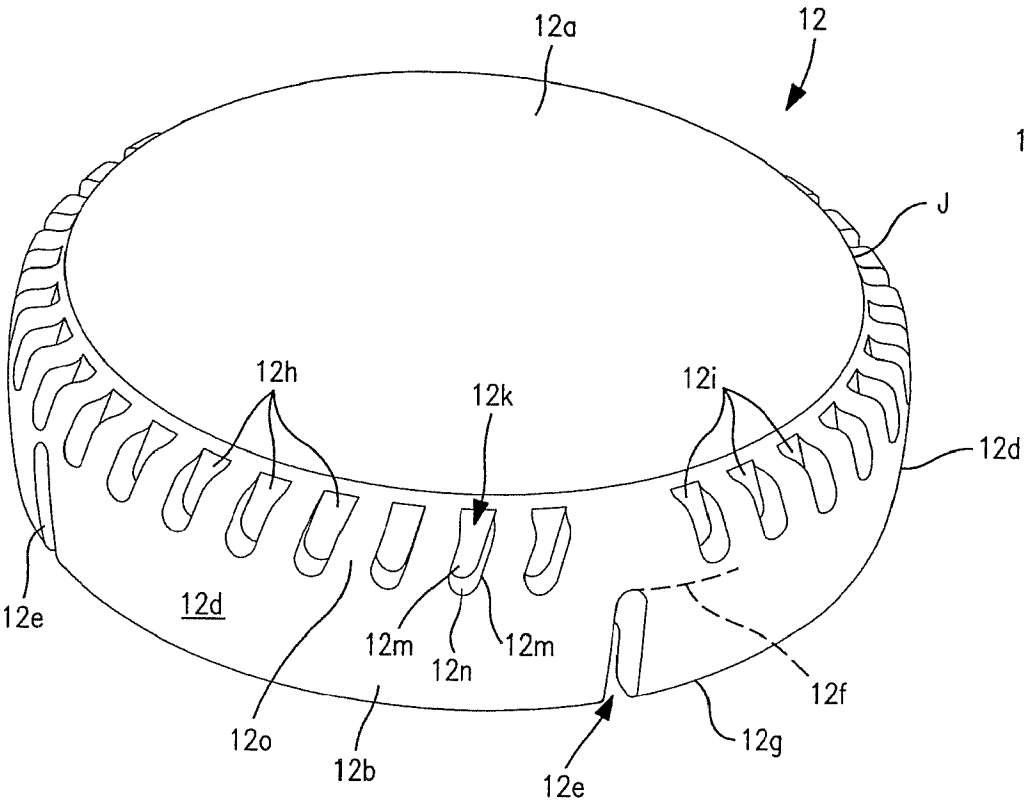
FIG. 8 is a perspective view of the topside of the inner cap of FIG. 2 showing drive notches.

The skirt outer surface at the juncture J with top panel 12*a* contains two sets of notches 12*h*, 12*i* (FIGS. 6-8) with each set occupying approximately one-half the perimeter of the skirt at the juncture of top panel, with one set of notches 12*h* being canted to the right, the other set 12*i* canted to the left. Each notch of both sets is defined by access opening 12*k* through top perimeter surface of skirt, depending, parallel side walls 12*m*, and a curved bottom 12*n* joining the bottom edges of side walls. The side walls 12*m* (and each notch) are off-set from vertical by an acute angle of between 2° and 30° and preferably at an angle of approximately 15°. Preferably, the notches are spaced from each other by skirt lands 12*o* haying a width approximately equal to notch width between parallel side walls. This arrangement provides the uniform appearance of the inner cap as best seen in FIG. 8. The right hand notches 12*i* are canted to the left, and left notches 12*h* to the right as seen in FIG. 8. The notches cooperate with outer cap drive teeth described below.

An outer cap 14 (FIGS. 3-5) according to the invention comprises top panel 14*a* and skirt 14*b* depending from the perimeter of the panel. The outer cap skirt has a partially spherical or curved inner surface 14*c* (e.g., a spherical section) of the same curvature as the outer surface 12*d* of the inner cap skirt. The outer cap then is snapped in place over the inner cap with the inner cap skirt flexing inward between slits 12*e* to accommodate such assembly. By reason of the partially spherical or curved surface interface of outer cap skirt with inner cap skirt, the outer cap tilts in every direction with respect to the inner cap. The degree of tilt is a function of cap diameter, and for typical consumer use in hand removal of the cap, the degree of tilt is in an approximate range of from 1° to 10°, and preferably approximately 5° to 7°. See FIGS. 9 and 10 where the degree of tilt is indicated by angle a defined by tilt of top panel 14*a* with respect to panel 12*a*.

Figure 5:
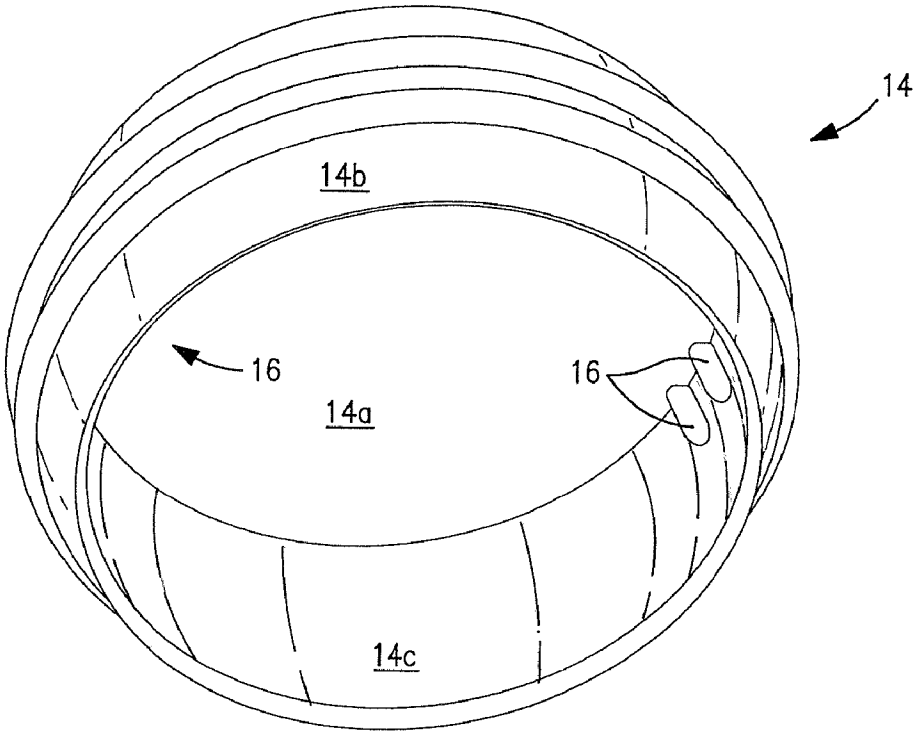
FIG. 5 is a perspective view of the underside of the outer cap of FIG. 2 showing drive teeth.

On the inside of the outer cap at the junction of top panel 14*a* and depending skirt 14*b*, the outer cap is fitted with a plurality of drive teeth 16 (seen best in FIG. 5) for insertion into the inner cap notches 12*h*, 12*i* for twisting the inner cap off the container neck. The teeth 16 depend from inside the outer cap as seen in FIGS. 2-5, 9, and 10. As shown in FIG. 5, the teeth 16 comprise a pair of ribs integral with underside of top panel 14*a* and the inner surface 14*c* of inner cap skirt. The base of each rib is joined to the under side of outer cap top panel, and a side of each rib is integral with outer cap skirt inner surface. The ribs are spaced apart a distance approximately equal to the spacing 12*o* between adjacent notches so that the ribs or teeth when in use cooperate with adjacent notches. It is preferred that the ribs be formed vertical in the outer cap so that a set of teeth is equally able to cooperate with both right and left hand notches. They may also be canted to the same degree as notches as described above.

The drive teeth are preferably set in pairs at diametrically opposed positions (FIG. 4) on the underside of the outer cap, and engage inner cap notches by tilting the outer cap with respect to the inner cap. A user selects direction of tilt by using either right hand or left hand according to natural ability, and twists outer cap either to right or to left in removing inner cap to open the container.

As shown in FIGS. 1 and 9 for right hand use, the outer cap tilts to the right to engage teeth and notches. The cap is removed to open the container by a twist in the direction of open arrow, and resealed by a twist in the opposite direction of close arrow. FIGS. 1 and 10 illustrate corresponding action for left handed use.

It is thus understood that the inner cap and the outer cap are assembled to each other at an interface defined by their partially spherical or curved surfaces and are thus capable of rotating freely with respect to each other. The outer cap is capable of being tilting with respect to the inner cap by movement of the outer cap with respect to the inner cap about the interface. By tilting the outer cap in a first direction the outer cap engages the inner cap by means of engagement of teeth and notches for turning the inner cap on the container in one of a right hand and a left hand direction, and by tilting the outer cap in a second direction the outer cap engages the inner cap, i.e., outer cap teeth engage inner cap notches for turning the inner cap on the container in the other of a right hand and a left hand direction.

The child-proof position of the closure cap is shown in FIG. 2 with outer cap in level position with respect to inner cap, and particularly, with drive teeth disengaged from inner cap notches. Any effort to turn the outer cap results in the cap sliding on inner cap curved surface without turning the inner cap.

It is to be understood then, a child proof right and left hand operable closure cap according to the invention comprises two operating components readily fabricated using commonly available plastic or equivalent material in well known manufacturing processes including plastics molding and metal stamping.

The term approximately for purposes of this application means plus or minus 10% of the values stated.

Various changes may be made to the structure embodying the principles of the invention. The foregoing embodiments are set forth in an illustrative and not in a limiting sense. The scope of the invention is defined by the claims appended hereto.

I claim:

1. A child-proof closure cap for a container, comprising:

an inner cap having a first top panel and a first skirt extending downward from the first top panel, the first skirt having a partially spherical outer surface extending downward and outward from the first top panel and a plurality of notches with upwardly directed openings around a circumference of the partially spherical outer surface, wherein an inner surface of the first skirt includes threads for engaging corresponding threads on the container; and an outer cap over said inner cap, said outer cap having a second top panel and a second skirt extending downward from the second top panel, the second skirt having a partially spherical inner surface extending downward and inward from the second top panel in spherical engagement with the partially spherical outer surface of the first skirt, the partially spherical inner surface of the second skirt including a plurality of teeth projecting inward from the partially spherical inner surface;

wherein, by tilting said outer cap, at least a portion of the teeth on the inner surface of the second skirt engage at least a portion of the notches on the outer surface of the first skirt for turning said inner cap on the container.

2. The closure cap according to claim 1, wherein each of the openings is on the partially spherical outer surface and displaced below the first top panel.

3. The closure cap according to claim 1, wherein the partially spherical outer surface is a spherical section.

4. The closure cap according to claim 1, wherein the partially spherical inner surface is a spherical section.

5. The closure cap according to claim 1, wherein, when the first top panel is substantially parallel to the second top panel, said outer cap rotates about said inner cap without engagement of teeth and notches.

6. The closure cap according to claim 1, wherein each of the plurality of notches is canted from vertical.

7. The closure cap according to claim 6, wherein each of the plurality of notches is canted from vertical by an angle in a range of 2° and 30°.

8. The closure cap according to claim 1, wherein the at least a portion of the teeth engage the notches on the outer surface of the first skirt upon tilting said outer cap by 1° to 10°.

9. The closure cap according to claim 1, wherein the at least a portion of the teeth engage the notches on the outer surface of the first skirt upon tilting said outer cap by 5° to 7°.

10. The closure cap according to claim 1, wherein the plurality of notches occupy approximately one-half of the circumference of the partially spherical outer surface.

11. A child-proof closure cap for a container, comprising:

an inner cap having a first top panel substantially perpendicular to an axis of rotation of said inner cap with respect to the container and a first skirt extending from the first top panel in a direction of the axis of rotation, the first skirt having a convexly curved outer surface extending downward from the first top panel and a plurality of notches around a circumference of the convexly curved outer surface with openings adjacent to the first top panel, wherein an inner surface of the first skirt includes threads for engaging corresponding threads on the container; and an outer cap over said inner cap, said outer cap having a second top panel and a second skirt extending substantially perpendicular from the second top panel, the second skirt having a concavely curved inner surface extending downward from the second top panel in rotatable engagement with the concavely curved outer surface of the first skirt, the concavely curved inner surface of the second skirt including a plurality of teeth projecting inward from the concavely curved inner surface;

wherein, by rotating said outer cap about an axis perpendicular to the axis of rotation, at least a portion of the teeth on the convexly curved outer surface of the second skirt engage at least a portion of the notches on the concavely curved inner surface of the first skirt for turning said inner cap on the container.

12. The closure cap according to claim 11, wherein each of the openings is on the convexly curved outer surface and displaced below the first top panel.

13. The closure cap according to claim 11, wherein, while rotating said outer cap with respect to said inner cap, the convexly curved outer surface of the first skirt maintains continuous contact with concavely curved inner surface of the second skirt.

14. The closure cap according to claim 11, wherein each of the plurality of notches is canted from the axis of rotation.

15. The closure cap according to claim 11, wherein at least a portion of the convexly curved outer surface is a spherical section.

16. The closure cap according to claim 11, wherein at least a portion of the concavely curved inner surface is a spherical section.

17. The closure cap according to claim 11, wherein, when the first top surface is substantially parallel to the second top surface, said outer cap rotates with respect to the said inner cap.

18. The closure cap according to claim 11, wherein, when the first top surface is titled at least five degrees with respect to second top surface, said inner cap rotates with said outer cap.

19. A child-proof closure cap for a container, comprising:

an inner cap having a first top panel and a first skirt having an annular curved outer surface extending downward from the first top panel the first skirt having a curved outer surface, the first skirt having a curved outer surface and a plurality of notches with upwardly directed openings displaced below the first top panel around a circumference of the curved outer surface, wherein an inner surface of the first skirt includes threads for engaging corresponding threads on the container;

an outer cap over said inner cap, said outer cap having a second top panel and a second skirt having an annular curved inner surface extending downward from the second top panel, in spherical engagement with the curved outer surface of the first skirt, the curved inner surface of the second skirt including a plurality of teeth projecting inward from the curved inner surface;

wherein, by tilting said outer cap, the curved outer surface of the first skirt maintains continuous contact with curved inner surface of the second skirt and at least a portion of the teeth on the inner surface of the second skirt engage at least a portion of the notches on the outer surface of the first skirt for turning said inner cap on the container; and wherein at least a portion of the curved inner surface is a spherical section.

20. The closure cap according to claim 19, wherein, when the first top panel is substantially parallel to the second top panel, said outer cap rotates with respect to the said inner cap.

* * * * *